United States Patent [19]

Filip

[11] 4,027,130

[45] May 31, 1977

[54] CABLE ACTIVATED SWITCH

[75] Inventor: Stanislaw F. Filip, Don Mills, Canada

[73] Assignee: I.C.S. Ignition Control Systems Ltd., Montreal, Canada

[22] Filed: July 17, 1975

[21] Appl. No.: 596,847

[52] U.S. Cl. ..... 200/161; 200/61.87; 200/153 F

[51] Int. Cl.[2] ..... H01H 17/08

[58] Field of Search ..... 260/153 F, 161, 61.18, 260/61.87

[56] References Cited

UNITED STATES PATENTS

| | | | |
|---|---|---|---|
| 2,500,182 | 3/1950 | Huertas | 200/161 X |
| 3,703,620 | 11/1972 | Watanabe | 200/161 |
| 3,798,402 | 3/1974 | Raab | 200/161 |
| 3,870,846 | 3/1975 | Filip | 200/161 |

*Primary Examiner*—James R. Scott
*Attorney, Agent, or Firm*—Finnegan, Henderson, Farabow & Garrett

[57] ABSTRACT

A cable activated switch comprising a hollow housing having opposed open ends to permit passage of a cable there-through. Guide means is provided in the housing for restricted planar displacement of the cable extending therethrough. A pair of spaced electrical contacts are secured in the housing. A contact bridge member is resiliently biased in a direction away from the contacts and in alignment therewith. The contact bridge is displaced against its biased direction by tensioning the cable between the opposed open ends of the housing whereby the contact bridge will contact the pair of electrical contacts to form an electrical flow path therebetween.

4 Claims, 5 Drawing Figures

CABLE ACTIVATED SWITCH

BACKGROUND OF INVENTION a. Field of the Invention

The present invention relates to a cable activated switch, and more particularly to a switch which is securable at any location along a cable length.

b. Description of Prior Art

There exists a need for the provision of a switch which can be secured along a brake cable having a wire rope axially displaceable within a cable housing. This type switch would be particularly useful on brake cables as utilized on pleasure vehicles such as snowmobiles and motor bikes where the brake of the vehicle is activated by a lever or other hand grip means provided on the handle bar of the vehicle. It is required that this type switch be water and moisture proof and be adapted for mounting anywhere along the length of the cable.

SUMMARY OF INVENTION

According to the above requirement, it is therefore a feature of the present invention to provide a cable activated switch capable of being secured in the cable length.

A still further feature of the present invention is to provide a cable activated switch which is water and moisture proof and which is easy to install and does not require mounting brackets.

It is a still further feature of the present invention to provide a cable activated switch wherein the wire rope extending axially within a cable housing can be exchanged without dismantling the switch.

According to the above features, from a broad aspect, the present invention provides a cable activated switch comprising a hollow housing having opposed open ends to permit passage of a cable therethrough. Guide means is provided in the housing for restricted planar displacement of the cable extending therethrough. A pair of spaced electrical contacts are secured in the housing. A contact bridge member is resiliently biased in a direction away from the contacts and in alignment therewith. The contact bridge is displaced against its biased direction by tensioning the cable between the opposed open ends of the housing whereby the contact bridge will contact the pair of electrical contacts to form an electrical flow path therebetween.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
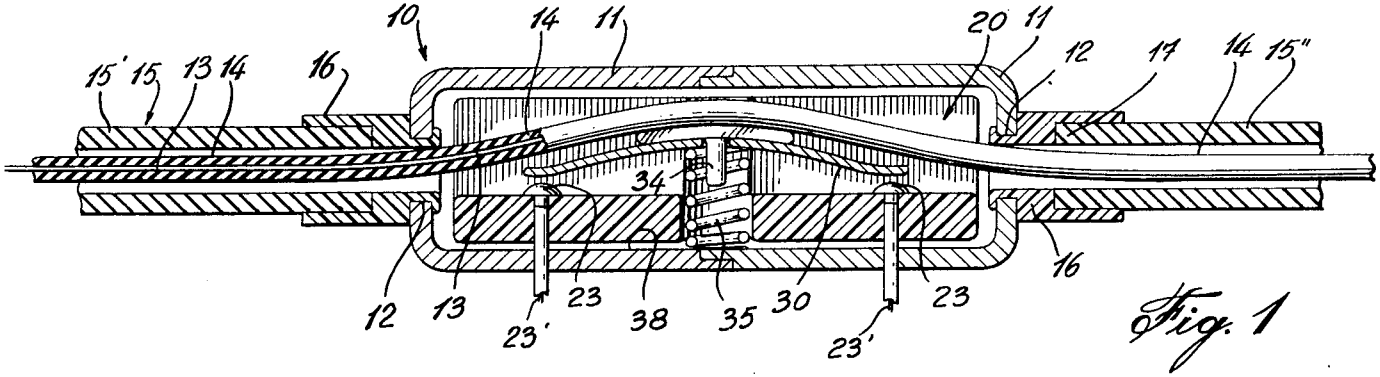
FIG. 1 is a sectional view through the switch of the present invention and a portion of a cable extending therethrough and showing the switch in an open contact position.

Referring now to the drawings, there is shown generally at 10, the cable activated switch of the present invention. The switch 10 comprises a hollow housing 11, formed of suitable material, and having opposed open ends 12 to permit passage of a wire rope 13 therethrough. The wire rope 13 is hereinshown as being encased within an insulating flexible covering 14. The wire rope 13 also extends in a cable housing 15. The cable housing 15 is severed to permit the switch 10 to be secured about a portion of the wire rope 13. A connector 16, herein a ferrule, is secured to each of the open ends 12 of the housing 11 for securing an end 17 of respective cable sections 15' and 15'' about a respective one of the open ends 12. Thus, a portion of the wire rope 13 will extend through the housing 11 between the open ends 12.

Guide means hereinshown as a cable guide member 20 (see FIG. 3) is located within the hollow housing 11 whereby to impart restricted planar displacement of the portion of the wire rope 13 which extends through the housing. The cable guide member 20 is an elongated barlike member of circular cross section defining spaced-apart side walls 21 and an interconnecting wall 22 extending between the side walls 21. The side walls 21 define a restricted plane therebetween and permits displacement of the wire rope 13 therebetween. A pair of electrical contacts 23 are secured in the interconnecting wall 22 which is constructed of an insulated material whereby the contacts are insulated from one another.

The contact bridge member 30 (see FIG. 5) is resiliently biased in a direction away from the contacts 23 and in alignment therewith. The contact bridge member is displaced against the biased direction by tensioning the wire rope 13 between the opposed open ends 12 of the housing 11 whereby the contact bridge member 30 will be urged downwardly and contact the pair of electrical contacts 23 to form an electrical flow path therebetween.

Figure 3:
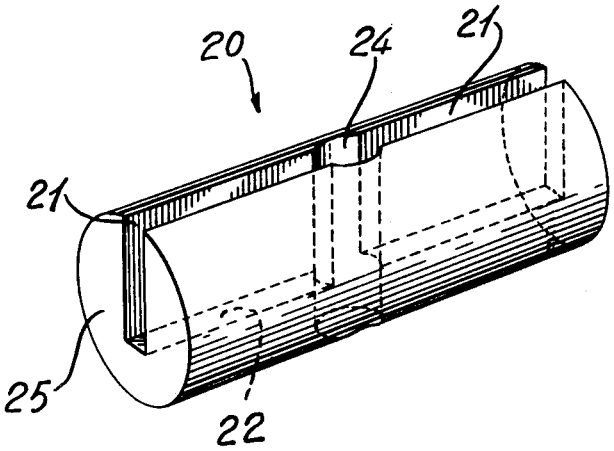
FIG. 3 is a perspective view of the cable guide member.
Figure 4:
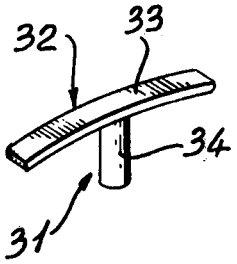
FIG. 4 is a perspective view of the cable support member.
Figure 5:
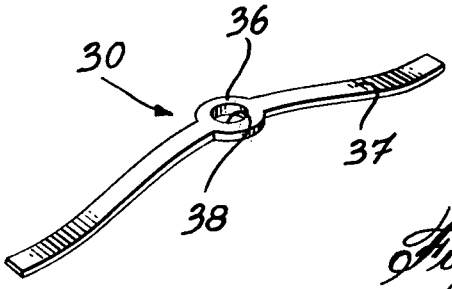
FIG. 5 is a plan view of the contact bridge.

Referring now more specifically to FIGS. 3, 4 and 5, it can be seen that a through bore 24 extends in the cable guide member 20 and positioned transversely to the long axis of a cable extending between the opposed walls 21 and the ends 25 of the guide member. A cable support member 31 (see FIG. 4) is located between the side walls 21 and consists of an arcuate supporting flange 32 having a convex support face 33 which is concave in cross section whereby to receive a portion of a side wall of the covering 14 about the wire rope 13. A guide post 34 is secured at one end thereof to the supporting flange 32 and substantially centrally of this flange.

As shown in FIG. 1, a helical tension spring 35 is positioned about the guide post 34 at an upper end thereof. The helical spring 35 is retained within the lower part of the through bore 24. The bridge member 30 is held under the arcuate portion of the flange 32 by the upper end of the helical spring 35 and is biased against the underface of the flange 32.

As shown in FIG. 5, the contact bridge 30 comprises an annular interconnecting central portion 36 and opposed elongated arms 37 extending therefrom. The annular interconnecting portion has a hole 38 which will permit loose passage of the guide post 34 therethrough.

Figure 2:
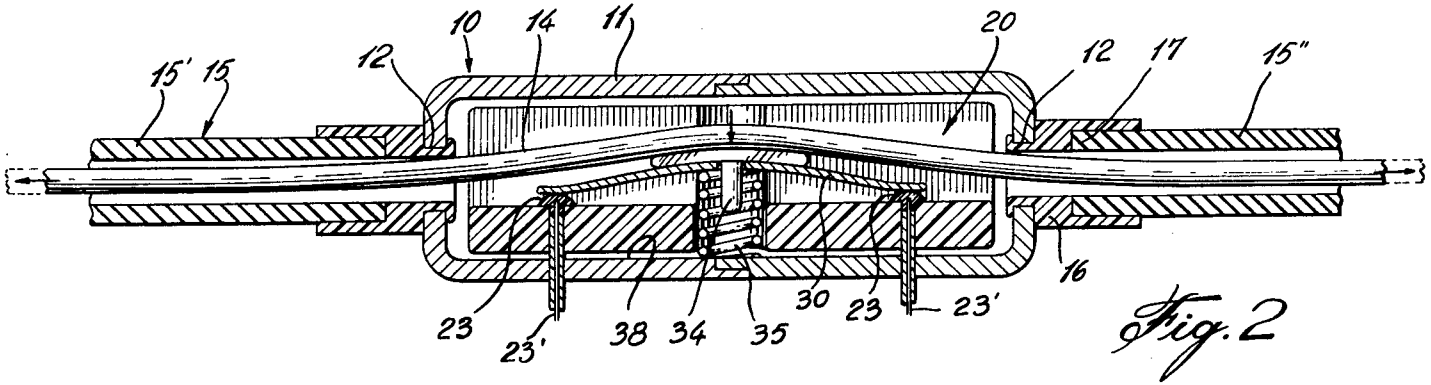
FIG. 2 is a sectional view as in FIG. 1 but showing the switch in a closed contact position.

As shown in FIG. 1, the contact bridge member 30 and the cable support member 31 are biased by the electrical spring 35 in a direction away and above the pair of contacts 23. The wire rope 13 rests on the upper face 33 of the support member 31 and is caused to deflect upwardly in the plane defined between the side walls 21 of the guide member 20. Thus, the wire rope portion extending through the housing and through the cable guide member 20 is axially displaced in a restricted plane defined between the side walls 21. By tensioning the wire rope 13 between the opposed open ends 12 of the housing 11, as shown in FIG. 2, the helical spring 35 is compressed by the movement of the support member 31 being urged downwardly against the contact bridge 30. Also, the elongated arms 37 of the contact bridge will engage a respective one of the pair of contacts 23 whereby to form an electrical flow path between the contacts 23 via the contact bridge 30. By releasing the tension in the wire rope 13, the compression force in the helical spring 35 will cause the support member 31 to move upwardly and displace the wire rope portion extending through the housing in an upward direction in the plane between the side walls 21 of the cable guide member 20. This displacement in the wire rope section also causes a wire activating lever (not shown) to resume its normal position.

The helical spring 35 has a predetermined compression force whereby to cause the required displacement of the wire rope portion extending through the housing. As herein shown, the lower end of the helical spring 35 is in abutment with an inside surface 38 of the housing 11. As further hereinshown, the cable guide member 20 is held stationary within the housing 11 by the electrical contact connections 23′ extending the interconnecting wall 22 and the housing 11.

Although not shown, an adjusting screw may be retained in the wall of the housing 11 in alignment with the helical spring 35 whereby the lower end of the spring 35 can be positioned in abutment with displaceable means (not shown) which may be caused to be movable axially by adjustment of the screw (not shown). This would permit adjustment of the required tension of the cable to cause the said displacement of the contact bridge 30 to engage the pair of electrical contacts 23. This would eliminate the necessity of dismantling the housing to replace the helical tension spring 35.

In a specific application of the cable activated switch of the present invention, the cable is a brake activating cable for a pleasure vehicle such as a snowmobile or motorcycle. One or more brake lights (not shown) are connected in a circuit with the pair of electrical contacts whereby the brake lights will be lit when the contact bridge 30 is displaced to form the electrical flow path between the pair of contacts 23. In this type of an arrangement, the wire rope is normally connected to a lever secured to the handle bar of the vehicle.

In the switch construction of the present invention, only the electrical contacts 23 and the contact bridge 30 need to be of electrically conductive material. All other parts may be constructed of any suitable material.

I claim:

1. A cable activated switch comprising a hollow housing having opposed open ends to permit passage of a cable therethrough, a cable guide member having spaced apart side walls and an interconnecting wall between said side walls, said side walls defining a slot therebetween to permit restricted planar displacement of said cable therebetween above said interconnecting wall, a pair of electrical contacts secured in said interconnecting wall and insulated from one another, a contact bridge member resiliently biased in a direction away from said contacts and in alignment therewith, said contact bridge member being in support contact with a portion of said cable extending through said housing, said bridge member being resiliently biased against said portion of said cable whereby said cable is displaced in a curved path in said slot, said contact bridge being displaced against said biased direction by tensioning said cable between said opposed open ends of said housing whereby said curved cable portion will straighten and displace said contact bridge to contact said pair of electrical contacts to form an electrical flow path therebetween.

2. a cable activated switch as claimed in claim 1 wherein a through bore extends in said cable guide member and transversely to the long axis of a cable extending through said guide member, a cable support member having an arcuate supporting flange defining a convex support face for engagement with said portion of said cable, a guide post secured at one end to said supporting flange and substantially centrally thereof, a helical tension spring positioned about said guide post and having an upper end, said bridge member being held under said arcuate supporting flange by said helical spring upper end biased thereagainst.

3. A cable activated switch as claimed in claim 2 wherein said helical spring has a predetermined compression force, said spring being in abutment at its lower end with an inside surface of said housing.

4. A cable activated switch as claimed in claim 2 wherein said contact bridge comprises an annular interconnecting central portion and opposed elongated arms extending therefrom, said annular interconnecting portion receiving said guide post therethrough.

* * * * *